US010557280B2

(12) United States Patent
Washko

(10) Patent No.: US 10,557,280 B2
(45) Date of Patent: Feb. 11, 2020

(54) BEACH UMBRELLA POST WITH INTEGRATED SUCTION SYSTEM AND METHOD

(71) Applicant: Michael A. Washko, Barto, PA (US)

(72) Inventor: Michael A. Washko, Barto, PA (US)

( * ) Notice: Subject to any disclaimer, the term of this patent is extended or adjusted under 35 U.S.C. 154(b) by 0 days.

(21) Appl. No.: 15/806,135

(22) Filed: Nov. 7, 2017

(65) Prior Publication Data

US 2018/0128004 A1 May 10, 2018

Related U.S. Application Data

(60) Provisional application No. 62/418,438, filed on Nov. 7, 2016.

(51) Int. Cl.
*E04H 12/22* (2006.01)
*A45B 23/00* (2006.01)

(52) U.S. Cl.
CPC ..... *E04H 12/223* (2013.01); *A45B 23/00* (2013.01); *E04H 12/2215* (2013.01); *E04H 12/2246* (2013.01); *A45B 2023/0012* (2013.01)

(58) Field of Classification Search
CPC ... A45B 3/44; A45B 23/00; A45B 2023/0012; E04H 12/2246; E04H 12/223; E04H 12/2215
See application file for complete search history.

(56) References Cited

U.S. PATENT DOCUMENTS 4,148,455 A 4/1979 Oliver
4,319,600 A * 3/1982 Roche ..... A45B 25/22 135/20.3
5,122,014 A 6/1992 Genfan
5,207,406 A 5/1993 Stine
5,385,161 A * 1/1995 Loker ..... A45B 11/00 135/15.1
5,535,978 A * 7/1996 Rodriguez ..... E04H 12/2269 135/118
5,636,944 A 6/1997 Buttimore
5,692,720 A * 12/1997 Griggs ..... A45B 23/00 135/15.1
5,711,333 A * 1/1998 Vanderminden, Sr. ..... A45B 17/00 135/20.1
6,176,246 B1 * 1/2001 Lin ..... A45B 25/143 135/22
6,267,127 B1 * 7/2001 Doreste ..... A45B 17/00 135/15.1
6,463,946 B1 * 10/2002 Wu ..... A47B 11/00 108/50.12
6,810,893 B1 * 11/2004 Nevin ..... A45B 25/16 135/22

(Continued)

FOREIGN PATENT DOCUMENTS

DE 202004017297 U1 * 2/2005 ..... A45B 23/00
WO WO-2011067432 A1 * 6/2011 ..... A45B 25/22

*Primary Examiner* — Eret C McNichols
(74) *Attorney, Agent, or Firm* — Ryder, Mazzeo & Konieczny LLC; Douglas J. Ryder

(57) ABSTRACT

A beach umbrella post having a suction system whereby the post of the beach umbrella is configured to suction sand when inserted into a soft surface via a plunger enabling the beach umbrella to anchor without the use of external weights or digging tools. The beach umbrella post with integrated suction also includes a release mechanism to expel sand from the inner compartment when use is ended.

23 Claims, 6 Drawing Sheets

(56) References Cited

U.S. PATENT DOCUMENTS 7,665,477 B1 * 2/2010 Hathaway ..... A45B 25/006 135/16
7,950,200 B2 * 5/2011 Tropiano ..... E04H 12/2223 135/98
8,082,934 B1 12/2011 Kucinski
8,444,105 B2 * 5/2013 Silvestri ..... E04H 12/2215 248/156
8,534,304 B1 * 9/2013 Tung ..... A45B 17/00 135/16
9,834,906 B1 * 12/2017 Linares ..... A45B 3/00
2003/0062073 A1 * 4/2003 Tung ..... A45B 17/00 135/20.1
2003/0079766 A1 * 5/2003 Arrowood ..... A45F 3/44 135/16
2004/0040591 A1 * 3/2004 Ma ..... A45B 25/143 135/98
2006/0016950 A1 1/2006 Bright
2006/0156600 A1 * 7/2006 Barker ..... G09F 17/00 40/591
2006/0241647 A1 * 10/2006 Chen ..... B25D 1/00 606/100
2007/0210235 A1 * 9/2007 Hood ..... F16B 47/00 248/519
2008/0146367 A1 * 6/2008 Cruz ..... A63B 47/02 473/286
2011/0126870 A1 * 6/2011 Luo ..... A45B 17/00 135/20.3
2013/0019914 A1 * 1/2013 Tung ..... A45B 17/00 135/98
2013/0206194 A1 * 8/2013 Ma ..... A45B 25/02 135/22
2016/0183647 A1 * 6/2016 Ma ..... A45B 17/00 135/20.1
2017/0099919 A1 * 4/2017 Mullet ..... A45B 25/143
2017/0306714 A1 * 10/2017 Haugland ..... E21B 27/02
2018/0371784 A1 * 12/2018 Gonzalez ..... E04H 12/2246

* cited by examiner

BEACH UMBRELLA POST WITH INTEGRATED SUCTION SYSTEM AND METHOD

CROSS-REFERENCE TO RELATED APPLICATION(S)

The present application is related to and claims priority to U.S. Provisional Patent Application No. 62/418,438 filed Nov. 7, 2016, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

Technical Field

The present invention relates generally to the field of canopies of existing art and more specifically relates to a beach umbrella. The invention also relates to the field of fishing supplies as it may be adapted for use as a surf fishing pole post.

Related Art

Umbrellas are an important article to pack for any visit to the beach. This is because umbrellas are often used by beachgoers to provide areas of shade when relaxing in the sun. Beaches can be very windy places due to the proximity to large bodies of water. Thus, umbrellas are likely to blow away if they are not secured or anchored sufficiently. Likewise, surf fishermen require a sand post that accepts the fishing pole to keep it upright after casting and also to anchor it against the force of hooked catch.

Conventional beach umbrellas and shades may include an elongated, rigid, support post with a pointed tapered end which may be imbedded into the sand by exerting a downward force on the support post while moving the support post back and forth in an angular manner.

However, lifting forces of the wind, wind gusts or subsequent rocking movement of the umbrella in loose sand may result in the umbrella being uplifted and/or completely dislodged from the sand. This may create a hazardous condition since the wind, after uplifting the umbrella, will cause the umbrella to roll or tumble along the beach surface exposing beachgoers in its vicinity to potential injury.

Achieving a secure fit for the post can be a difficult and time-consuming task that typically requires the user to dig a hole deep enough to provide support and then back-fill the hole with loose sand/dirt. Alternatively, the umbrella user may employ specially designed fixtures such as pole spikes or screw attachments that require non-trivial amounts of physical effort and/or secondary implements such as a hammer to fasten them into place. Such attachment methods become increasingly difficult if not impossible as the water content within the sand increases, experienced either with a receding tide or as the site location approaches the water's edge. If unable to secure the post with the methods described above at the intended location, the user will be forced to relocate to another, less desirable location where a hole can be created. U.S. Pat. No. 5,636,944 to Edward P. Buttimore relates to an anchor for a beach umbrella. The described anchor for a beach umbrella includes a canopy and a support post therefore comprising a container having a predetermined hollow, solid geometric configuration capable of being buried in and containing sand, the container including an open top, a bottom and a side wall extending from the open top to the bottom, the bottom having an aperture therein coaxial of a longitudinal axis of the container; a cylindrical member secured in the aperture and extending at least downward from the bottom externally of the container coaxial of an extension of the longitudinal axis to receive an end of the support post; and an arrangement to secure the cylindrical member to the one end of the support post and, hence, to secure the container to the support post.

SUMMARY OF THE INVENTION

In view of the foregoing disadvantages inherent in the known beach umbrella art, the present disclosure provides a novel beach umbrella post with integrated suction system and method. The general purpose of the present disclosure, which will be described subsequently in greater detail, is to provide an umbrella post which may be pressed down into a sand surface while simultaneously raising a slide-able external ring that actuates a plunger mechanism comprising of an attachment mechanism, a connecting rod, and a seal mechanism within the post. As the slide-able external actuator ring is raised, the mechanism creates a vacuum within the tube that in turn creates a small void at the leading sand/post-edge interface into which the post may be depressed through a simultaneous downward motion. If the desired post depth is not initially achieved, then the umbrella post may be removed from its insertion hole while maintaining the slide-able external actuator ring at its highest position and the sand plug captured within the post may then be discarded from the hole by pushing the slide-able external actuator ring to the lowest position. Once complete, a user may repeat the steps until a desired depth is achieved. Unlike the methods described earlier, the efficiency with which the invention is inserted is actually improved in sand with increasing water content, helping to maintain suction throughout the insertion process.

The beach umbrella post with integrated suction system provides the user with a quick, and easy apparatus and method for installing a post in soft ground, such as sand, to support beach umbrellas, canopies, flags, fishing poles and other items, in a secure and upright position. Advantageously, the beach umbrella post with integrated suction system requires little exertion so that the umbrella post may be installed by the elderly, handicapped, as well as adolescents and children. This eliminates the need to carry additional implements, such as a shovel. It also eliminates the need to dig holes within which the post would otherwise be inserted.

The beach umbrella post with integrated suction system provides an exceptionally secure fit by removing a plug of sand/soil equal to a diameter of the umbrella post. This minimizes disturbance to the surrounding sand that would otherwise contribute to a looser and less secure insertion. The secure fit provided by the invention minimizes the potential for injury that may occur when a beach umbrella or canopy is uprooted by a gust of wind. Further, the beach umbrella post with integrated suction system is exceptionally easy to dislodge after use as the slide-able external actuator ring simply needs to be depressed downward to expel sand, which in turn pushes the umbrella post out of the hole.

A beach umbrella post with integrated suction system is disclosed herein. The beach umbrella post with integrated suction system may be adapted to provide support for a structure or to be used as surf fishing pole holder. The post may generally comprise: a cylindrical tube defined by an inner wall and an outer wall; a free-sliding plunger mechanism having an upper part, a lower part, and a connecting tube and being located inside of the cylindrical tube; a slide-able external actuator ring; a longitudinal slot(s) located towards the center portion of the wall of the cylindrical tube; an integrated suction mechanism, and a connector that attaches the slide-able external actuator ring to the suction mechanism. Alternatively, the post may be designed with parallel, opposite facing longitudinal slots that allow the connector to extend through both tube walls.

According to another embodiment, a method of using the beach umbrella post with integrated suction system is also disclosed herein. The method for installing a post in sand or soft ground that requires minimal exertion may comprise the steps of: step one, positioning the bottom of the post against the sand; step two, pressing down on the post and raising a slide-able external actuator ring simultaneously in order to create a suction within a hollow portion of the bottom of the post that in turn creates a void along the leading sand/tube-edge interface into which the post is simultaneously depressed; and step three, pulling up a volume of the sand into the hollow portion of the post as a result of the suction created, such that the surrounding sand is undisturbed allowing for a secure fit between the post and the sand to promote stability in use.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a beach umbrella post with integrated suction system and method, constructed and operative according to the teachings of the present disclosure.

The various embodiments of the present invention will hereinafter be described in conjunction with the appended drawings, wherein like designations denote like elements.

DETAILED DESCRIPTION

Figure 1:
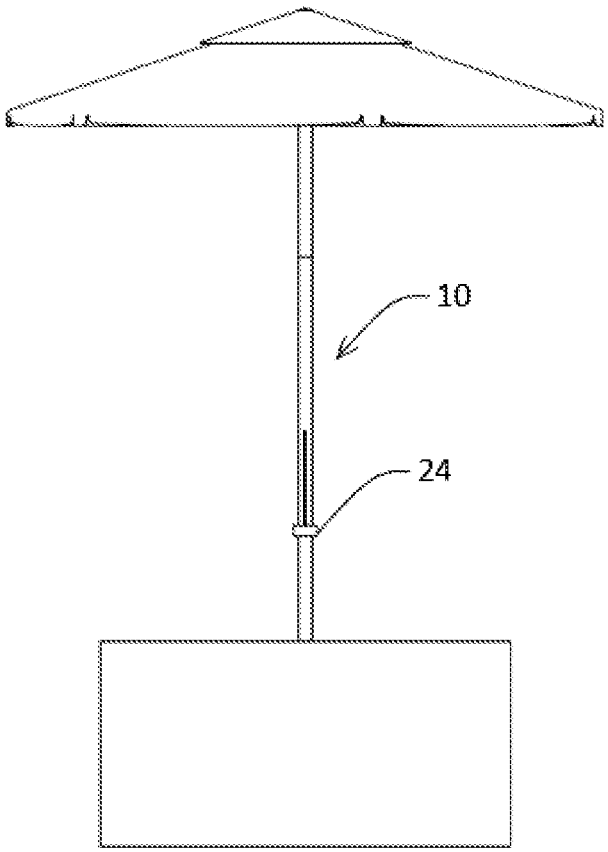
FIG. 1 is a perspective view of a post for providing support for a structure comprising a beach umbrella according to an embodiment of the disclosure.

As discussed above, embodiments of the present disclosure relate to a beach umbrella and more particularly to a beach umbrella post with integrated suction system and method as used to improve the ability to anchor a beach umbrella without requiring separate tools.

Generally, the present invention provides users with a substantially effortless method to install a beach umbrella post or other anchor post into the ground. The device may include a slotted cylindrical tube with a free-sliding, inner plunger. The inner plunger comprises of an upper part, a lower part, and a connecting tube. The lower part of the plunger may have a seal mechanism to provide a tight fit between the plunger and the inner tube wall to create the suction necessary for sand/ground removal. The seal mechanism may contain a fibrous material or bristles located at the top and bottom of the seal mechanism so that debris such as sand is removed from the inner tube wall during actuation of the plunger mechanism. The fibrous material or bristles function to keep debris away from the seal elements so that the suction and the longevity of the seal mechanism is maximized.

The lower part of the plunger may be located a few inches from the bottom of the umbrella tube in its lowest position so that it accepts an initial plug of sand/ground that may then be drawn further into the tube through suction. The plunger length may be longer than the length of the slot in the cylindrical tube to ensure that suction is maintained throughout the entire actuator range. The upper part of the plunger may have a solid and durable head with an alignment slot located below the head that extends through the center of the attachment mechanism such that the alignment slot is perpendicular to the circular cross-section of the connector tube. The alignment slot shall be bounded on one side by a center wall that extends the width of the attachment mechanism but is slightly offset to the slot such that the slot bisects the center of the connecting tube. The attachment mechanism may have a plurality of other vertical ribs or walls that function to connect the durable head to the durable footer as well as to connect the durable footer to the connector tube so that upward and downward force applied to the attachment mechanism may be transmitted through the connector tube to the lower part of the plunger that contains the seal mechanism.

The slot in the attachment mechanism is capable of receiving a rod or connector strip that is long enough to extend beyond the outer tube wall(s) so it may be attached to the external slide-able external actuator ring. The connector strip may be flexible enough to slide over the integrated attachment features in the attachment mechanism. The attachment mechanism may have an alignment wall that enables blind insertion of the connector strip as it is inserted from the outer side of the cylindrical tube, through the slot in the cylindrical tube and into the internal attachment mechanism. The alignment wall may be perpendicular to the circular cross-section of the plunger tube but angled relative to the alignment slot. The alignment wall extends from the outer edge of the attachment mechanism towards the center and ending at the alignment slot. The angle between the center wall and the alignment wall of the attachment mechanism guides the connector strip towards the alignment slot and ultimately provides self-alignment of the plunger upon full insertion. The attachment mechanism may have integrated features that fix the connector strip within the alignment slot in the lateral direction to facilitate attachment of the slide-able external actuator ring. The insertion edge of the connector strip may be rounded or angled to facilitate self-alignment of the strip within the upper and lower bounds of the alignment slot in the actuator mechanism. The connector strip may also have cut-outs that facilitate physical connection with the integrated attachment features of the attachment mechanism as well as physical attachment to the slide-able external actuator ring.

The slide-able external actuator ring may have an inner dimension that is slightly wider than the outer dimension of the umbrella pole. The upper and lower ends of the slide-able external actuator ring may be rounded to minimize friction and wear to the post and sized to minimize the rocking motion of the slide-able external actuator ring around the post. The slot(s) in the cylindrical tube should be made as thin as possible to allow for free movement of the slide-able external actuator ring while maintaining structural integrity of the post. The slots may be positioned towards the center of the post and extend from the upper plunger attachment mechanism when the attachment mechanism is in its lowest position to a length that is shorter than the plunger itself. The length of the slot relative to the plunger is vital to ensure that the seal remains airtight when the slide-able external actuator ring is raised to its highest setting. This preserves the suction created within the tube so that the sand/ground plug may be removed from the hole. The top portion of the head may be solid so as to maintain structural integrity.

In use, the user may place the bottom of the pole against the sand/ground and press down on the pole while simultaneously raising the slide-able external actuator ring to create a sand plug via suction within the bottom of the umbrella post. If the desired depth is not attained in the first try, the post may then be removed from the sand while keeping the actuator ring at its highest setting. Once the post is removed from the hole, the sand/ground plug may be expelled away from the hole by pushing the slide-able external actuator ring to its lowest setting. The umbrella post may then be reinserted into the hole and the user may then once again push downward on the pole while raising the slide-able external actuator ring until the desired post depth is achieved.

Figure 2:
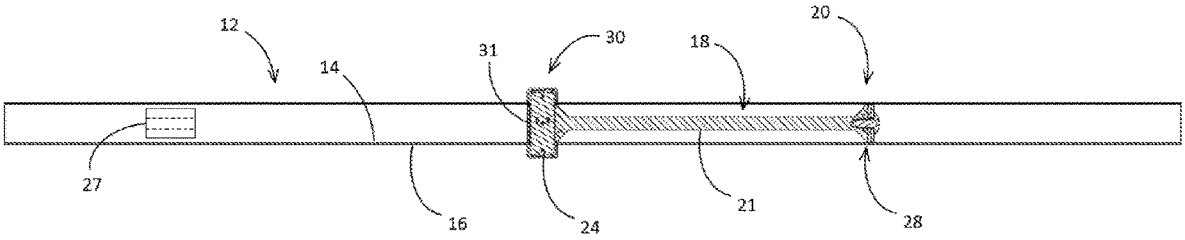
FIG. 2 is an interior view of the post showing internal components of the post and the plunger according to an embodiment of the disclosure.

Referring now more specifically to the drawings by numerals of reference, there is shown in FIGS. 1-6, various views of a post 10 for providing support for a structure. Referring to FIG. 1 showing a perspective view of a post for providing support for a structure comprising a beach umbrella. Here, the post 10 may be beneficial for use by a user 40 to anchor a structure, such as a beach umbrella, into a soft surface (such as sand). As illustrated in FIG. 2, the post 10 may include cylindrical tube 12, the cylindrical tube 12 defined by an inner wall 14 and an outer wall 16; a free-sliding plunger 18, the free-sliding plunger 18 having an upper part (attachment mechanism) 30 and a lower part (seal mechanism) 20 attached by a connector tube 21 and being located inside of the cylindrical tube 12; a slide-able external actuator ring 24; longitudinal slot(s) 26, the longitudinal slot(s) 26 located on the outer wall 16 of the cylindrical tube 12 and extending through the inner wall 14; an integrated suction mechanism; and such that the post 10 is configured for providing support for the structure.

In referring to FIG. 1, the beach umbrella post with integrated suction system and method 2 is shown in an installed condition. The post 10 may comprise a top and a bottom. As may be seen, the top end may be configured to support a structure (such as a beach umbrella). It should be appreciated that other structures may be supported by the top-end for example canopies, sunshades, tents, surf fishing poles, and the like. As further may be seen, the bottom may be configured to penetrate a soft surface such as sand, soil, dirt, and the like. Advantageously, the free-sliding plunger and slide-able external actuator ring (24) may be used in combination with the post 10 to facilitate the user 40 (not shown) in penetrating and installing the beach umbrella post with integrated suction system and method 2.

In one embodiment of the present invention the post 10 may be fabricated using aluminum or other durable light-weight material. It should be noted that other materials may be used such as steel, ceramic, plastic, graphite and the like in other embodiments.

Referring now to FIG. 2 illustrating a side view of the post 10 internally comprising an integrated suction mechanism and the free-sliding plunger 18 according to an embodiment of the disclosure. As shown, the integrated suction mechanism may comprise a plurality of seal elements 28, located at a lower part of the free-sliding plunger 18, that have fibrous material at the top and bottom of the seal mechanism to remove debris such as sand and to maximize suction as well as longevity of the seal mechanism 20. The seal elements 28 may provide a tight seal between the free-sliding plunger 18 and the inner wall 14 of the cylindrical tube 12.

In one embodiment of the present invention, the lower part of the free-sliding plunger 18 may be located approximately a couple inches from the bottom of the cylindrical tube 12, when the free-sliding plunger 18 is in its lowest position. The length of the free-sliding plunger 18 may be approximately 30 percent of the length of the cylindrical tube 12 but not less than the slot length 26 in the cylindrical tube.

Figure 4:
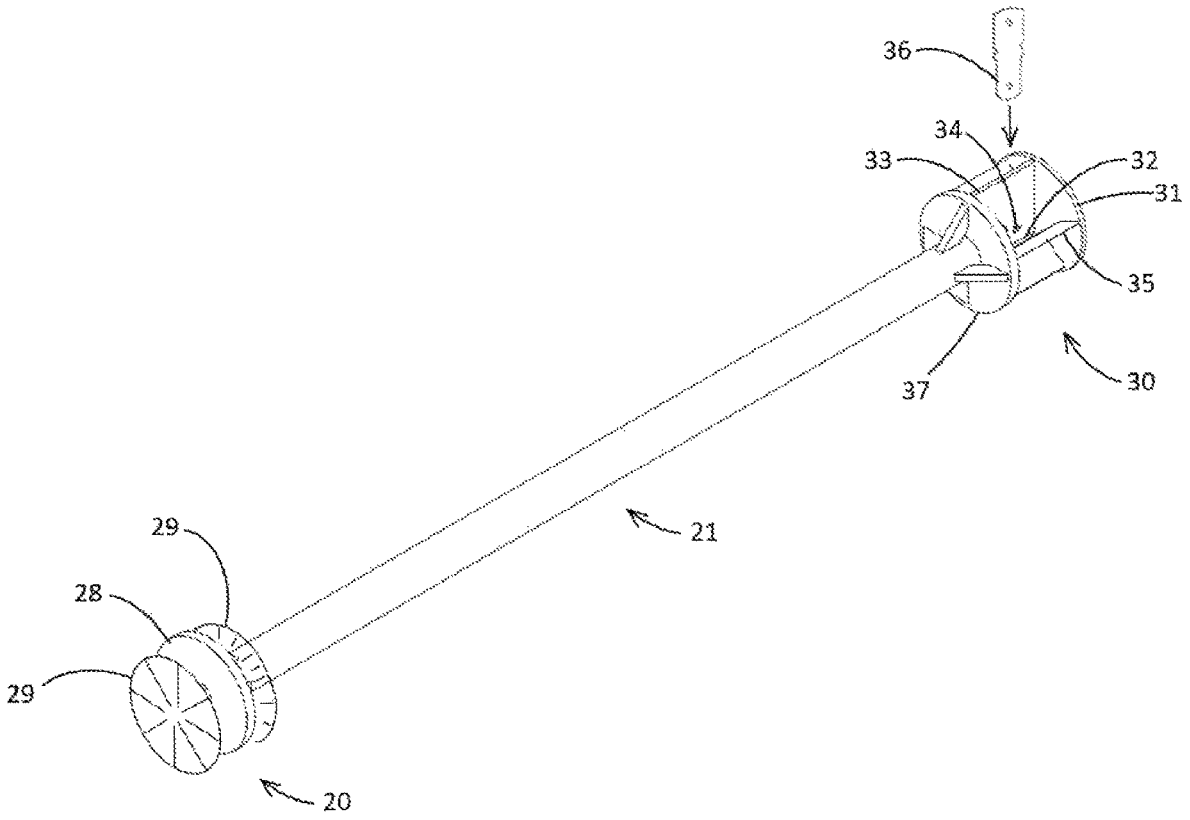
FIG. 4 is another perspective view of the plunger comprising an upper part (attachment mechanism), a lower part (suction mechanism), and a connector tube and their features described according to an embodiment of the disclosure.

Referring now to FIG. 4, the upper part (attachment mechanism) 30 of the free-sliding plunger 18 in shown comprising a solid and durable head 31 with a hole and alternately an alignment slot 32 in a center of the upper part (attachment mechanism) 30 that is perpendicular to the circular cross-section of the free-sliding connector tube 21. The hole and alternately the alignment slot may be configured to receive a rod and or a metal connector strip 36 that is substantially long enough to extend beyond the outer wall 16 of the cylindrical tube 12.

In one embodiment of the present invention, the slide-able external actuator ring 24 in FIG. 2. may have an inner diameter that is larger than an outer diameter of the cylindrical tube 12 such that the slide-able external actuator ring 24 may be moved along the outer wall 16 of the cylindrical tube 12 The slide-able external actuator ring 24 may be connected to the free-sliding plunger 18 such that vertical movement of the free-sliding plunger 18 may be controlled by the movement of the slide-able external actuator ring 24.

Figure 3A:
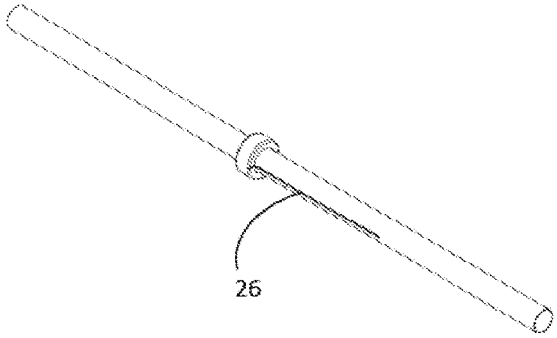
FIG. 3A is a perspective view of the post having a plurality of slots and a plunger according to an embodiment of the disclosure.
Figure 3B:
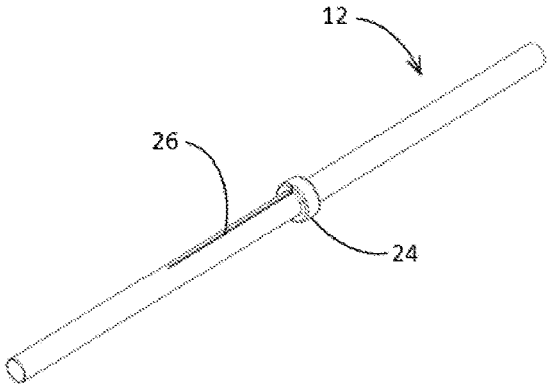
FIG. 3B is a perspective view of the post having a plurality of slots and a plunger according to an embodiment of the disclosure.

Referring now to FIG. 3A-3B illustrating perspective views of the post 10 having a slot(s) 26 to allow connection to the free-sliding plunger 18 according to an embodiment of the disclosure. The slot 26 may extend from the upper part (attachment mechanism) 30 of the free-sliding plunger 18 when the upper part (attachment mechanism) 30 is in its lowest position to a length along the center of the cylindrical tube that is shorter than the free-sliding plunger 18 itself.

Referring now to FIG. 4 illustrating a detailed view of the plunger comprising the upper part (attachment mechanism) 30, a seal mechanism 20 and a connector tube 21. The upper part (attachment mechanism) 30 is comprised of an alignment slot 32 that is bounded by a center wall 33 according to an embodiment of the disclosure. The center wall 33 of the upper part (attachment mechanism) 30 may contain integrated attachment features 34 that fasten the connector strip 36 in the lateral direction. The upper part (attachment mechanism) 30 may have a durable head 31 that accepts the upward vertical force of the slide-able external actuator ring 24 and transmits the said force through a plurality ribs, including the center wall 33 and the alignment wall 35, to the durable footer 35 and connector tube 21 and the seal mechanism 20 to create the suction that facilitates post insertion. Likewise, the solid and durable footer 35 accepts the downward vertical forces of the slide-able external actuator ring 24. The alignment slot 32 may be configured to receive a rod or a metal strip that is blindly inserted from the outside through the cylindrical tube slot 26 and into the upper part (attachment mechanism) 30 with the aid of an alignment wall 35 that provides an angled connector acceptance feature for self-alignment of the plunger 18 during insertion of the connector strip 36. The connector strip 36 may be substantially long enough to extend beyond the outer wall 16 of the cylindrical tube 12 to enable attachment to the slide-able external actuator ring 24. The bottom part (seal mechanism) 20 consists of seal elements 28 that may be a plurality of spaced O-rings, rubber washers, foam, or another suitable element. The seal elements 28 may be capped on the upper and lower ends by fibrous material or bristles 29 to remove debris such as sand from the inner tube wall 14 during upward and downward motion of the slide-able external actuator ring 24 and plunger 18 to maximize suction during use and longevity of the seal mechanism 20.

Figure 5:
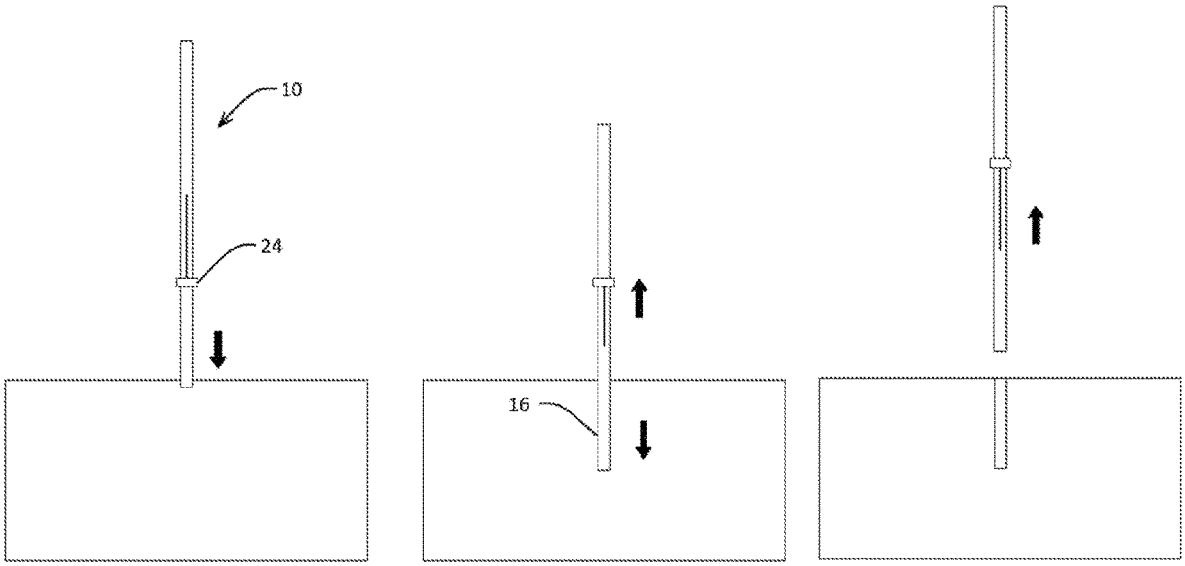
FIG. 5 shows several perspective views of the post configured to be inserted and removed from a soft surface according to an embodiment of the present disclosure.

Referring now to FIG. 5 illustrating several perspective views of the post 10 configured to be inserted and removed from a soft surface. As shown in the first drawing the post 10 may be depressed into a soft surface such as sand. As shown in the second drawing the slide-able external actuator ring 24 may be manipulated by the user via an upward pulling force causing the free-sliding plunger 18 to be pulled upward thereby suctioning sand into the cylindrical tube 12 and creating a void at the tube/sand interface such that the post 10 may be further depressed into the sand through a simultaneous downward motion.

Consequently, the post 10 accepts a plug of sand such that the sand surrounding the exterior post wall 16 is minimally disturbed thus further stabilizing and anchoring the post 10 within the soft surface. It should be noted the exertion required to pull the slide-able external actuator ring 24 upward while depressing the post into the sand is far less than the exertion required to plunge a pointed post into the soft surface. As shown in the third drawing, if the depth of insertion of the post 10 is insufficient then it may be removed by pulling the cylindrical tube 12 upwardly from the soft surface. When the post 10 is fully removed, the user 40 may push the slide-able external actuator ring 24 downwardly to expel the sand from the interior confine of the cylindrical tube 12. The process may then be repeated until the user 40 attains sufficient depth of insertion of the post 10.

A preferred embodiment of the beach umbrella post with integrated suction system and method 2 is disclosed herein comprising the post 10 for providing support for a beach umbrella. The post 10 comprising the cylindrical tube 12 defined by an inner wall 14 and an outer wall 16. The free-sliding plunger 18 may comprise an upper part (attachment mechanism) 30 and a lower part (seal mechanism) 20 fastened to a connector tube 21 and may be located inside of the cylindrical tube 12. The slide-able external actuator ring 24 may be attached through longitudinal slot(s) 26 located on the outer wall 16 of the cylindrical tube 12 to the upper part (attachment mechanism) 30 of the plunger 18.

The post 10 may be configured for providing support for the structure and may include an integrated suction mechanism comprising of seal elements 28, located at the lower part of the free-sliding plunger 18 that may provide a tight seal between the free-sliding plunger 18 and the inner wall 14 of the cylindrical tube 12. The bottom of the free-sliding plunger 18 may be located a couple inches from the bottom of the cylindrical tube 12, when the free-sliding plunger 18 is in its lowest position. The length of the free-sliding plunger 18 may be approximately 30 percent of a length of the cylindrical tube 12. The upper part (attachment mechanism) 30 of the free-sliding plunger 18 has a solid and durable head 31 with an alignment slot 32 in the center of the upper part (attachment mechanism) 30 that is perpendicular to the length of the free-sliding plunger 18.

The alignment slot 32 may be configured to receive a connector strip 36 that may be substantially long enough to extend beyond the outer wall 16 of the cylindrical tube 12. The slide-able external actuator ring 24 may have an inner diameter that may be larger than the outer diameter of the cylindrical tube 12. The longitudinal slot 26 may extend from the upper part (attachment mechanism) 30 of the free-sliding plunger 18 when the upper part (attachment mechanism) 30 is in its lowest position to a length that may be approximately 2 inches shorter than the length of the free-sliding plunger 18.

According to one embodiment, the beach umbrella post with integrated suction system and method 2 may be arranged as a kit. In particular, the beach umbrella post with integrated suction system and method 2 may further include a set of instructions. The instructions may detail functional relationships in relation to the structure of the beach umbrella post with integrated suction system and method 2 such that the beach umbrella post with integrated suction system and method 2 can be used, maintained, or the like, in a preferred manner.

Figure 6:
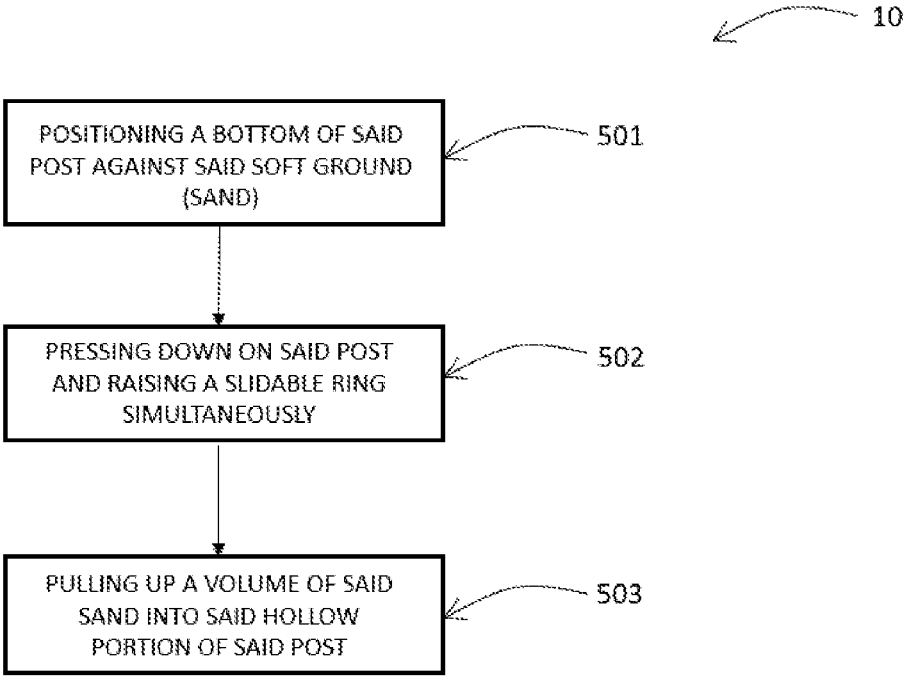
FIG. 6 is a flow diagram illustrating a method for installing the post in sand that requires minimal exertion according to an embodiment of the present disclosure.

FIG. 6 is a flow diagram illustrating a method for installing a post 10 in soft ground or sand that requires minimal exertion. As shown, the method may comprise the steps of: step one, positioning a bottom of the post 10 against the soft ground; step two, pressing down on the post 10 and raising a slide-able external actuator ring 24 simultaneously to create a suction within a hollow portion of the bottom of the post 10; step three, pulling up a volume of the soft ground into the hollow portion of the post 10 as a result of the suction created, whereby the pulling up of the soft ground into the hollow portion of the post 10 minimizes disturbance to material immediately surrounding the post 10 thus providing a secure fit between the post 10 and the soft ground to promote stability in use.

It should be noted that in step three that the step of installing the post 10 in soft ground may comprise installing the post 10 in sand. Alternatively, the step of installing the post 10 in soft ground may comprise installing the post 10 in soil.

It should further be noted that the step of pressing down on the post 10 may alternatively comprise the step of pressing down on an umbrella post or an anchor post. It should be appreciated that installing the post 10 in soft ground provides support for attaching an item. The item may be selected from the group comprising of an umbrella, a canopy, a flag, a fishing pole, and the like.

It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for beach umbrella post with integrated suction system and method 2 are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A post for providing support for a structure when the structure is located in a soft ground, said post comprising:

a hollow cylindrical tube having at least one slot providing an opening therethrough, wherein the at least one slot is located approximately at a center of said hollow cylindrical tube;

a free-sliding plunger located inside of said hollow cylindrical tube, wherein said free-sliding plunger includes an upper part, a lower part and a connector tube therebetween;

a slide-able external actuator ring;

an integrated suction mechanism coupled to the lower part of said free-sliding plunger; and a connector to secure said free-sliding plunger and said slide-able external actuator ring through the at least one slot.

2. The post of claim 1, wherein said integrated suction mechanism comprises a seal element and one or more cleaners, wherein said seal element is configured to provide a tight seal between said free-sliding plunger and an inner wall of said hollow cylindrical tube and wherein said one or more cleaners is configured to remove debris from said inner wall to maximize suction during use and longevity of the seal mechanism.

3. The post of claim 2, wherein said integrated suction mechanism is located approximately 1 inch from a bottom of said hollow cylindrical tube when said free-sliding plunger is in its lowest position to ensure sufficient penetration of said hollow cylindrical tube into the soft ground in order to establish suction.

4. The post of claim 3, wherein said free-sliding plunger has a length approximately 30 percent of a length of said hollow cylindrical tube.

5. The post of claim 1, wherein said upper part of said free-sliding plunger comprises an attachment mechanism with an opening formed in a center of said attachment mechanism, and wherein said opening is perpendicular to a cross-section of said free-sliding plunger.

6. The post of claim 5, wherein the opening is configured to receive the connector after the connector passes through the at the at least one slot of said hollow cylindrical tube.

7. The post of claim 5, wherein said attachment mechanism comprises a center wall and an alignment wall configured to facilitate blind insertion of said connector through said at least one slot of said hollow cylindrical tube and into said opening.

8. The post of claim 7, wherein said connector is configured to provide alignment of said connector with said attachment mechanism to facilitate blind assembly of said connector through said at least one slot of said hollow cylindrical tube into said attachment mechanism.

9. The post of claim 5, wherein said attachment mechanism comprises attachment features configured to position said connector in a lateral direction.

10. The post of claim 5, wherein said attachment mechanism is configured to accept vertical force of said slide-able external actuator ring and transmit the force to the internal plunger.

11. The post of claim 1, wherein said connector comprises a thin strip of material configured to transmit vertical forces from said slide-able external actuator ring to said free-sliding plunger.

12. The post of claim 1, wherein said connector is configured to be fastened to said slide-able external actuator ring.

13. The post of claim 1, wherein said slide-able external actuator ring has an inner diameter that is larger than an outer diameter of said hollow cylindrical tube.

14. The post of claim 1, wherein said connector includes a plurality of cut-outs; and said slide-able external actuator ring is configured to accept at least some portion of the plurality of cut-outs of said connector to provide a mechanical connection there between.

15. The post of claim 1, wherein said at least one slot is approximately 2 inches shorter than said free-sliding plunger so that said integrated suction mechanism is below said at least one slot over entire length of travel of said slide-able external actuator ring from its lowest possible setting to its highest possible setting so that suction is maintained for insertion operation.

16. A post for providing support for a structure when the structure is located in a soft ground, said post comprising:

a hollow cylindrical tube having at least one slot providing an opening therethrough, wherein the at least one slot is located approximately at a center of the hollow cylindrical tube;

a free-sliding plunger located inside of said hollow cylindrical tube, wherein the free-sliding plunger includes an upper part, a lower part and connection tube therebetween, wherein a length of said free-sliding plunger is approximately 30 percent of a length of said hollow cylindrical tube, and wherein the upper part includes an attachment mechanism having a center wall with an opening formed in a center thereof that is perpendicular to a cross-section of said free-sliding plunger and an alignment wall configured to facilitate blind insertion into the opening;

a slide-able external actuator ring, wherein said slide-able external actuator ring has an inner diameter that is larger than an outer diameter of said hollow cylindrical tube;

an integrated suction mechanism coupled to the lower part of said free-sliding plunger, wherein said integrated suction mechanism includes a seal element and a cleaner, wherein the seal element is configured to provide a tight seal between said free-sliding plunger and an inner wall of said hollow cylindrical tube, wherein the one or more cleaner is configured to remove debris from the inner wall to maximize suction during use, wherein said integrated suction mechanism is located approximately 1 inch from a bottom of said hollow cylindrical tube when said free-sliding plunger is in its lowest position; and a connector comprising a thin strip of material, wherein the connector is configured to secure said free-sliding plunger and said slide-able external actuator ring through the at least one slot, transmit vertical forces from said slide-able external actuator ring to said free-sliding plunger;

provide alignment of said connector with said attachment mechanism to facilitate blind assembly of said connector through said at least one slot of said hollow cylindrical tube into said attachment mechanism; and allow said connector strip to be fastened to said slide-able external actuator ring;

wherein the opening is configured to receive the connector after the connector passes through the at least one slot of said hollow cylindrical tube;

wherein said attachment mechanism comprises attachment features configured to position said connector in a lateral direction;

wherein said attachment mechanism is configured to accept vertical force of said slide-able external actuator ring and transmit the force to the internal plunger;

wherein said slide-able external actuator ring is configured to accept a plurality of cut-outs of said connector to provide a mechanical connection; and wherein said at least one slot is approximately 2 inches shorter than said free-sliding plunger so that said integrated suction mechanism is below said at least one slot over entire length of travel of said slide-able external actuator ring from its lowest possible setting to its highest possible setting so that suction is maintained for insertion operation.

17. The post of claim 16, further comprising a set of instructions; and wherein the post is arranged as a kit.

18. A method for installing a post for providing support for a structure to be located in soft ground that requires minimal exertion, wherein the post includes a hollow cylindrical tube having at least one slot providing an opening therethrough, a free-sliding plunger located inside of the hollow cylindrical tube, a slide-able external actuator ring located outside the hollow cylindrical tube, and a connector to secure the free-sliding plunger and the slide-able external actuator ring through the at least one slot, the method comprising:

positioning the slide-able external actuator ring to its lowest position which positions the free-sliding plunger to its lowest position within the hollow cylindrical tube, wherein the lowest position is a defined distance above a bottom of the hollow cylindrical tube;

positioning the bottom of the hollow cylindrical tube into the soft ground, pressing down on the hollow cylindrical tube and raising the slide-able external actuator ring simultaneously, in order to create a suction within the bottom of the hollow cylindrical tube, pulling up a volume of the soft ground into the bottom of the hollow cylindrical tube as a result of said suction created, wherein said pulling up of the soft ground into the bottom of the hollow cylindrical tube creates a void along a leading sand/post interface that allows the hollow cylindrical tube to be further depressed and provides a secure fit between the hollow cylindrical tube and the soft ground to promote stability in use.

19. The method of claim 18, wherein the soft ground is sand.

20. The method of claim 18, wherein the soft ground is soil.

21. The method of claim 18, wherein the post is an umbrella post.

22. The method claim of claim 18, wherein the post is an anchor post.

23. The method of claim 18, wherein the structure is selected from a group comprising of an umbrella, a canopy, a flag, and a fishing pole.

* * * * *